United States Patent [19]

Peyret, Jr.

[11] Patent Number: 4,662,641

[45] Date of Patent: May 5, 1987

[54] GOLF CLUB SWING TRAINING DEVICE AND METHOD

[76] Inventor: Louis F. Peyret, Jr., 918 Bel Air Rd., Pensacola, Fla. 32505

[21] Appl. No.: 654,184

[22] Filed: Sep. 24, 1984

[51] Int. Cl.[4] ..... A63B 69/36

[52] U.S. Cl. ..... 273/184 B; 273/200 B; 273/201; 273/183 A; 273/183 E

[58] Field of Search ..... 273/200 A, 200 B, 208, 273/183 A, 183 C, 184 R, 184 B, 185 C, 186 B, 187 R, 198, 197, 197 A, 201, 183 E

[56] References Cited

U.S. PATENT DOCUMENTS

| | | | |
|---|---|---|---|
| 1,224,410 | 5/1917 | Porte | 273/200 A |
| 1,677,557 | 7/1928 | Johnson | 273/184 B |
| 2,461,601 | 2/1949 | Hendricks | 273/208 |
| 2,695,175 | 11/1954 | Trapp | 273/184 B X |
| 3,754,761 | 8/1973 | Pruss | 273/200 A |

*Primary Examiner*—George J. Marlo
*Attorney, Agent, or Firm*—Peter J. Murphy

[57] ABSTRACT

A platform simulates a golfing surface on which the golfer takes his stance relative to an address position of a golf ball. Apparatus within the platform conveys a succession of golf balls in a linear path traversing the address position, and conveying the balls in a path adjacent to the simulated golfing surface and in a direction opposite from the intended direction of flight. The linear path is provided by an elongated slot in a simulated golfing surface. An endless conveyor belt underlying that slot carries a plurality of elongated tee members which are projected upward through the slot and carry balls along the path through the address position at a uniform rate of speed. The golfer then will time his swing to hit the ball when it reaches the address position, this encouraging the golfer to swing the clubhead through the ball rather than at it. The endless belt is supported on end wheels, and a bracket provides a support floor for the upper run of the belt parallel to the golfing surface. The golfing tee members are rubber-like tubular members communicating with the inner face of the belt through ports of the belt. A vacuum housing associated with one of the support wheels supplies vacuum to the tee members as they move around the wheel to the vertical position. A succession of golf balls are fed in a single feed trough to a pickup station; and the tee members under vacuum engage successive balls in the pickup station to lift the balls above the golfing surface where they are then conveyed through the address position.

18 Claims, 14 Drawing Figures

GOLF CLUB SWING TRAINING DEVICE AND METHOD

This invention relates to the teaching or training of golfers or prospective golfers to execute a proper golf swing; and more particularly to teaching prospective golfers to swing the golf club "through" the ball instead of "at" it.

There are many different theories on how to swing a golf club, but few if any professionals would disagree with the fact that the clubhead must be swung through the area where the ball is resting in order to make a successful golf shot. The inventor believes that most poor golf shots are the result of the golfer's physically trying to deliver his clubhead to the point where the ball is resting. Novice golfers, particularly, do this because they believe that the ball will go great distances if the club is swung hard at the ball. The natural instinct of the golfer, particularly in a situation where there is some pressure to make a good shot, is to swing the club at the ball instead of through it. The learning of a correct golf swing is difficult then, because what seems natural is wrong.

Before any particular theory of how to swing a golf club can be put into practice, the golfer must first completely understand that the golf swing is a free fluid movement back and forth. When watching different expert golfers, it will be apparent that the physical appearance of golf swings may be quite different. But one common aspect of all golf swings is also apparent, namely that the club is swung freely through the hitting area. Any golfer wanting to improve his game must practice getting his muscles more supple and free from tightness, to enable the free movement of the clubhead through the hitting area.

An object of this invention is to provide a novel method for practicing a golf swing.

Another object of this invention is to provide a novel apparatus and method for conveying a golf ball through the address position on a simulated golfing surface, for the practice of a golf swing.

A further object of this invention is to provide a novel apparatus and method for teaching a golfer to swing his golf club head through the ball at the address position, rather than directing the clubhead merely at the ball.

Still another object of this invention is to provide a novel apparatus and method which teaches a golfer to overcome his natural instinct to swing his club merely at the golf ball.

A still further object of this invention is to provide a novel apparatus for automatically picking up and conveying a succession of golf balls in a linear path through an address position, enabling the golfer to swing his clubhead through a moving golf ball.

These objects are accomplished broadly in apparatus which includes a platform providing a flat surface simulating a golfing tee or fairway surface. A linear path means is provided in that platform surface, defining the direction of flight of a golf ball from that surface. Means is provided in the platform for conveying an elongated golf tee member along the path means parallel to the platform surface, with the golf tee member projecting upwardly to carry and support the ball in a path slightly above the simulated golfing surface.

These objects are also accomplished broadly in a method which includes the steps: simulating a golfing surface; providing a linear path in that golfing surface for movement of a ball supporting tee member through an address position; conveying that tee member in an upright position along said path, in a direction opposite from the direction of intended ball flight; and mounting a golf ball on the tee member at the leading end of that path to enable initiation of a golf swing by the golfer to hit the moving golf ball when it reaches the address position.

These objects are also accomplished in a method for practicing a golf swing which is characterized by the steps: conveying a golf ball in a linear path through an address position on a golfing surface; adopting a golfing stance on that golfing surface, which golfing stance is related to the address position and to the linear path in that the expected initial flight path of the ball will be in a vertical plane coincident with the linear path and in a direction opposite from that of the ball conveyed along that path; and hitting the ball with a golf club by means of the usual golf club swing, when the ball is being conveyed through that address position.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
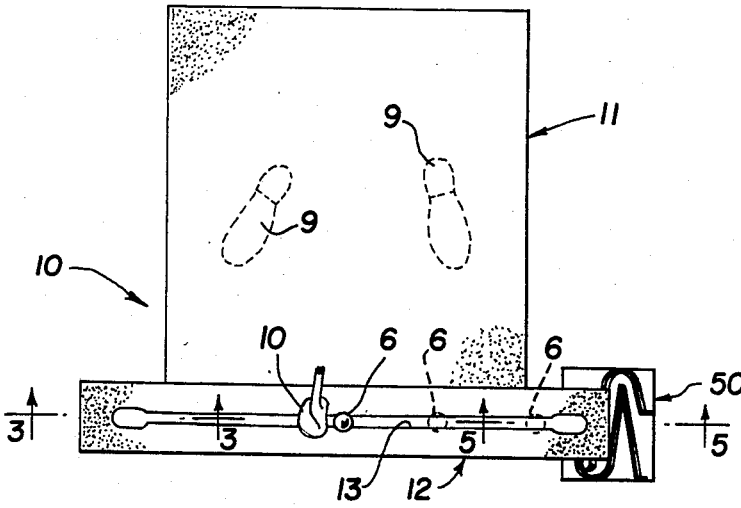
FIG. 1 is a top view of apparatus according to the invention.

Referring to the drawings, the apparatus of the invention consists basically of a platform 10 providing an elevated platform surface, which platform preferably consists of two portions or sections which are suitably joined together. The apparatus is suitable for use either indoors or outdoors; and the platform may be placed on either finished or paved surfaces or on the ground. The platform provides a platform surface elevated eight inches from the support surface for example.

Figure 2:
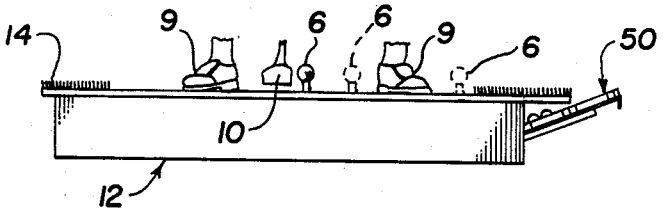
FIG. 2 is a front elevation view of the apparatus of FIG. 1.

The platform preferably consists of a base portion or section 11 and a ball support portion or section 12. The base section 11 is rectangular, or possibly square, as viewed from the top and is suitably constructed and dimensioned to support the weight of the golfer using the apparatus to practice his swing. The ball support section 12 is rectangular and elongated, as viewed from the top; and this top surface is provided with an elongated linear slot 13, aligned longitudinally and centrally of the ball support section, which slot defines a linear path for movement of a golf ball as will be described. The mechanism for moving golf balls along that linear path, moves the balls in only one direction relative to the platform surface, that direction being from right to left as illustrated in FIGS. 1 and 2 of the drawings. This assembly of the platform sections accommodates a right handed golfer who, standing on the base platform section 11, will hit the ball from left to right in FIG. 1. In order to accommodate a left handed golfer, the ball support platform section 12 is secured to the base section in a reverse manner; and the two platform sections are provided with suitable means for joining these sections together. The platform surfaces for both platform sections are covered with a suitable covering or carpet 14 simulating grass, so that the assembled platform 10 simulates a golfing surface such as a tee surface or a fairway surface.

The two platform sections are boxed to provide a pleasing appearance; and the ball support section encloses the mechanism for conveying a golf ball along the linear path.

In FIGS. 1 and 2, a golf ball 6 is illustrated, in full, in what will be referred to as an "address position", which is a position aligned approximately midway between the left and right edges of the base platform 11 as viewed in FIG. 1. This address position of the golf ball is the position relative to which the golfer would establish his golfing stance, and is desirably the position the ball will be in when the ball is impacted by the clubhead. FIGS. 1 and 2 also illustrate the relative positions of the right handed golfer's feet 9 and clubhead 10 at both the address position and the anticipated hitting position (the moment of impact of the ball by the clubhead). If the golfer has timed his swing correctly, the ball 6 will have arrived at the address position when the clubhead is returned to the address position during the downswing by the golfer. The golf ball 6 will be conveyed along the linear path at a uniform rate of speed to and through this address position, as indicated in broken lines in FIGS. 1 and 2; and the golfer will time his back swing and down swing to hit the ball when it reaches the address position. The golf ball 16 is conveyed along the linear path by an elongated tee member 17 which extends upright through the slot 13 and which supports the golf ball in the manner of a conventional golf tee. Preferably the ball is conveyed along a path coincident with the upper surface of the simulated golfing surface to simulate the effect of the golfer hitting the ball off the grass.

Figure 3:
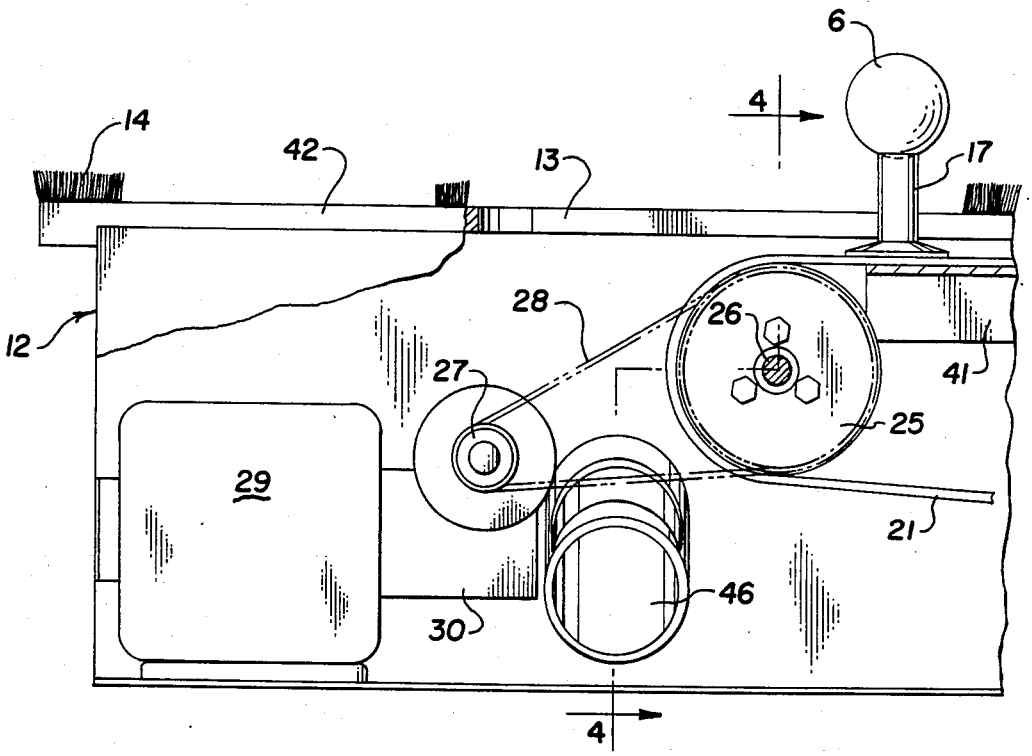
FIG. 3 is a fragmentary sectional view taken along the line 3—3 of FIG. 1.
Figure 4:
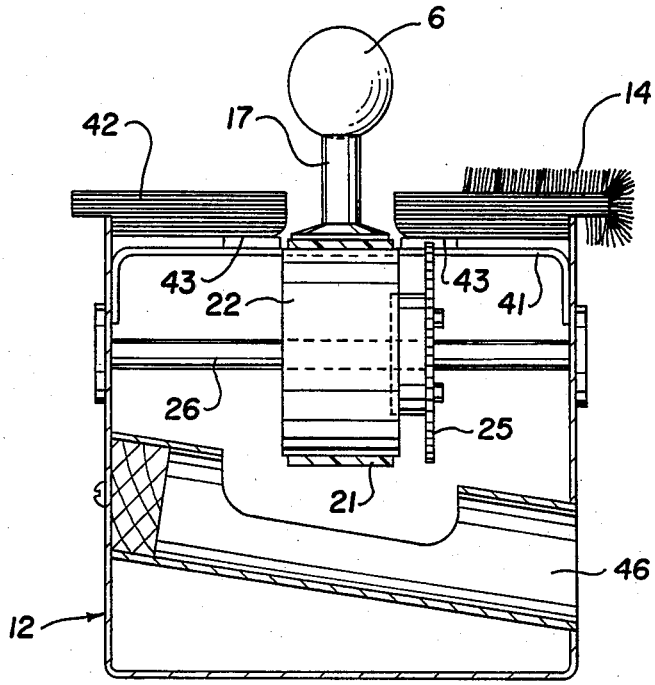
FIG. 4 is a vertical sectional view taken along the line 4—4 of FIG. 3.
Figure 5:
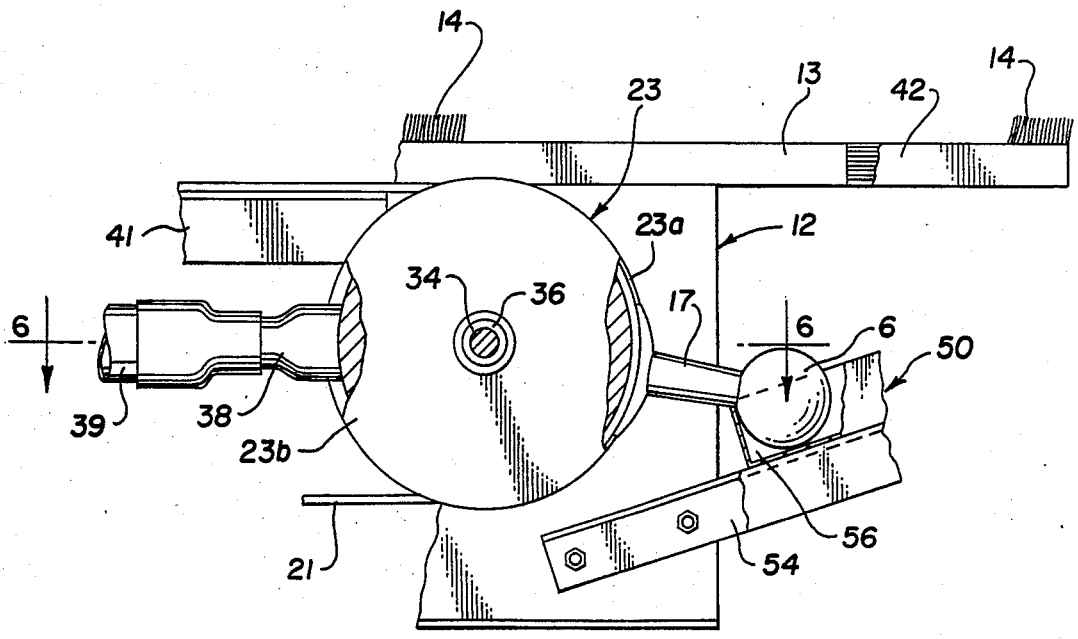
FIG. 5 is a fragmentary sectional view taken along the line 5—5 of FIG. 1.
Figure 6:
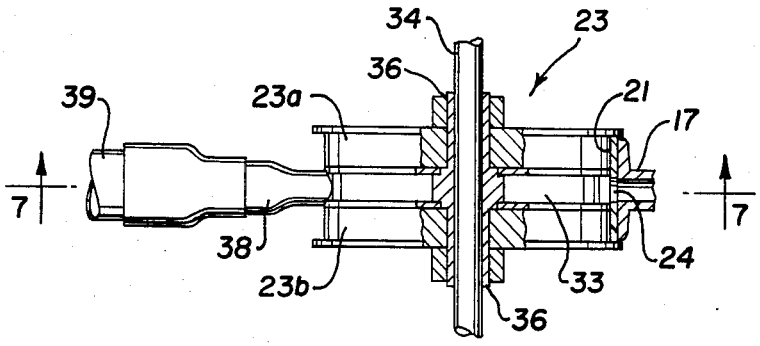
FIG. 6 is a fragmentary sectional view taken along the line 6—6 of FIG. 5.

FIGS. 3 through 6 of the drawings illustrate the mechanism by which golf balls 6 are conveyed along the linear path, FIGS. 3 and 5 being sectional views of the opposite ends of the ball support section 12, taken in vertical planes just inside the exterior wall of that section.

Referring particularly to FIGS. 3 and 5, a plurality of tee members 17 are mounted on an endless conveyor belt 21 which is supported at opposite ends by a drive wheel 22 and an idler wheel 23. The belt 21 is preferably flat in cross section, and is preferably fabricated from a flexible and resilient rubber-like material. The tee members 6 are also preferably fabricated from a flexible and resilient rubber-like material and are preferably elongated tubular members having an enlarged flat base whereby they are suitably joined to the belt 21 by a suitable cement for example. The distal ends of the tee members, opposite from their bases, present annular seats for retaining and supporting the golf balls, which seats are transverse to the tubular stem portions of the tee members. The belt is provided with transverse ports 24, extending through the belt webbing for communication with the hollow interiors of the tee members for a purpose to be described.

The drive wheel 22 and a driven sprocket 25 are mounted for rotation together on a shaft 26 which is suitably journaled in the ball support platform. A drive sprocket 27 drives the driven sprocket by a drive chain 28; and the drive sprocket is driven in turn by an electric motor 29 through a suitable speed reduction mechanism 30. The speed reduction mechanism may have means for varying the drive sprocket speed to accordingly change the rate of traversal of the golf balls along the linear path. By way of example, the apparatus may be set up to deliver a golf ball to the address position once each eight seconds, and the rate of linear travel of the golf ball may be inches per second. In the illustrated apparatus, the conveyor belt 21 may have three tee members mounted thereon in equally spaced relation, to present golf balls to the golfer at the desired rate.

Figure 7:
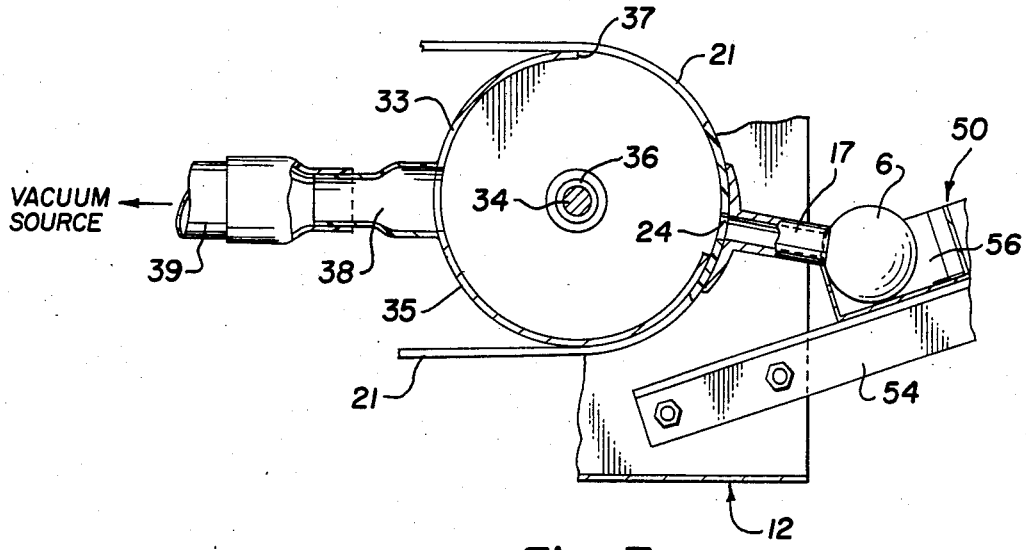
FIG. 7 is a vertical sectional view of the vacuum chamber taken along the line 7—7 of FIG. 6.
Figure 8:
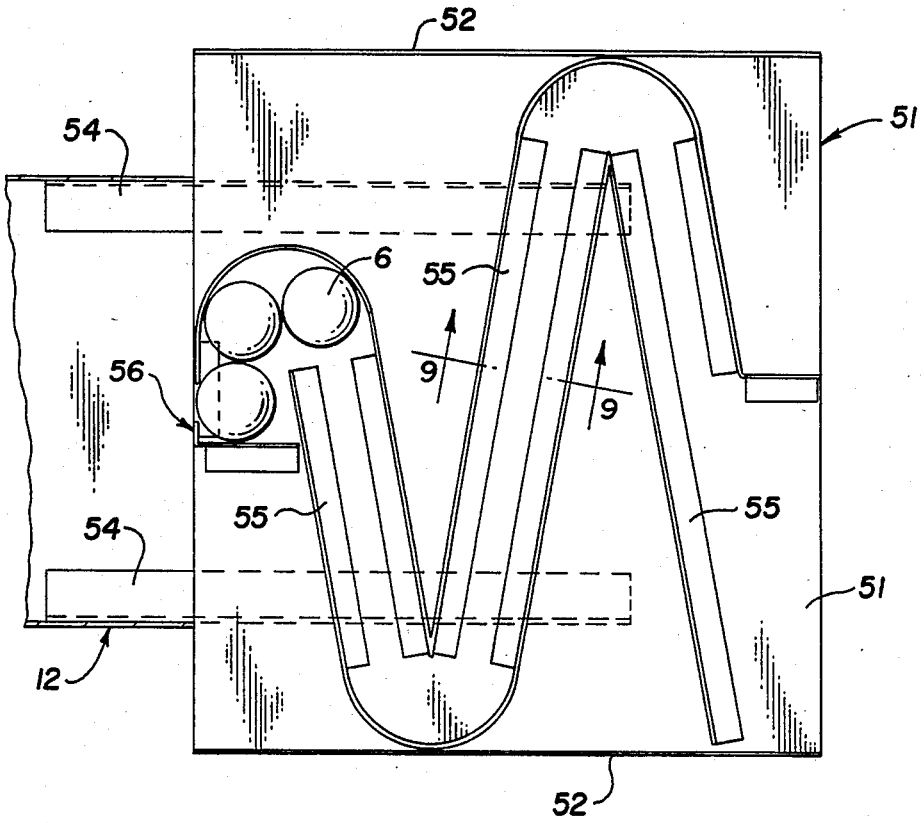
FIG. 8 is a plan view of the ball supply tray.

Referring particularly to FIG. 5, the idler wheel 23 consists of complementary idler wheel sections **23*a* and 23*b* which are mounted in association with a vacuum housing 33. The vacuum housing is in the form of a flat disk-like housing which is nonrotatably mounted on a shaft 34 extending between the side walls of the ball support section 12; and the housing presents a partially cylindrical surface 35 having the same diameter as the belt support portions of the idler wheel sections 23*a* and 23*b*. The vacuum housing is provided with laterally extending hubs 36 at opposite sides, coaxial with the shaft 34, which hubs support the idler wheel sections for rotation. The cylindrical surface 35 of the vacuum housing is provided with a circumferentially elongated inlet port 37, which is located generally in the upper right quadrant of the vacuum housing as viewed in FIG. 7, and which extends from a point somewhat below a horizontal plane passing through the idler wheel axis to a point somewhat to the left of a vertical plane passing through the idler wheel axis. An inwardly extending hose nipple 39 projects from the housing, and defines an outlet port for the housing to which is attached a suitable hose 39 for coupling a vacuum machine or suction device (not shown). Such vacuum machine may possibly be enclosed within the ball support section 12, or may be auxiliary apparatus which is connected to the ball support section by the hose 39. It will be seen then that as the conveyor belt 21 carries tee members 17 around the idler wheel, the hollow tee members are communicated with the vacuum chamber of the vacuum housing 33 by means of the inlet port 37 and the conveyor belt ports 34**. As will be described, the distal ends of the tee members are communicated with golf balls as the tee members are rotated upwardly approaching the horizontal position; and suction is then applied to the tee members to secure a golf ball to the annular seat, with the golf ball then being carried under this vacuum retention until the tee member reaches the upright position. At this point the vacuum communication is broken, and the golf balls merely rest on the tee member seating surfaces as the tee members are conveyed along the linear path.

In order to provide for smooth travel of the conveyor belt, tee members, and supported golf balls in that linear path, the upper run of the conveyor belt is supported by a bracket 41 providing a planar support floor exactly parallel to the platform surface 41 and spaced therefrom. As best seen in FIG. 4, the ball support section includes surface flooring 42 underlying the surface covering 14; and this surface flooring is supported along the slot 13 by means of spacer strips 43, which spacer strips also define lateral guides for the traversal of the conveyor belt upper run to assure linear travel of the tee members 17. Also, with this structure, the golf balls 6 are conveyed in uniform relation to the simulated golfing surface.

As best seen in FIG. 3, a ball discharge chute 46 is provided to discharge balls to the exterior of the ball support section 12 in the event that the golfer allows a ball to be conveyed through the address position. In this event, when the ball and its supporting tee member are carried over the drive wheel 22, the ball will drop into the discharge chute for discharge outside the platform, enabling retrieval and replacing in a ball supply tray to be now described.

Figure 9:
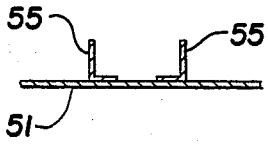
FIG. 9 is a sectional view taken along the line 9—9 of FIG. 8.

As best seen in FIG. 9 of the drawing, a preferred form of ball supply tray 50 is fabricated from sheet metal, and is formed to provide a planar floor 51 and side walls 52. The tray is supported by a pair of elongated linear brackets 54 secured to the floor 51 and extending from the other end to be secured to the side walls of the ball support section 12. The tray is mounted with its proximal end lower than its distal end, so that the balls placed at the upper or distal end will roll toward the proximal end. The tray is provided with interior wall members 55 which form a trough for a single row of golf balls 6, which trough is arranged in zig-zag or tortuous form, and which trough terminates in a ball pickup station 56 adjacent to the proximal edge of the tray. The tray is so mounted, relative to the ball support section 12, that a golf ball 6 positioned in the ball pickup station 56 will be engaged by the distal end of a tee member 17 as it is carried around the idler wheel 23. When this engagement occurs, vacuum has already been applied to the hollow tee member so that the ball is retained on the tee member and carried around this idler wheel to the vertical position. The tortuous ball trough is provided in the ball supply tray 50 to enable the storage of an adequate number of balls in a compact tray, 30 for example; and the trough is arranged to minimize the lateral pressure applied by the stacked balls to the ball in the ball pickup station. This lateral pressure should be minimized so as to not interfere with the pickup of the ball by the tee member.

Figure 11:
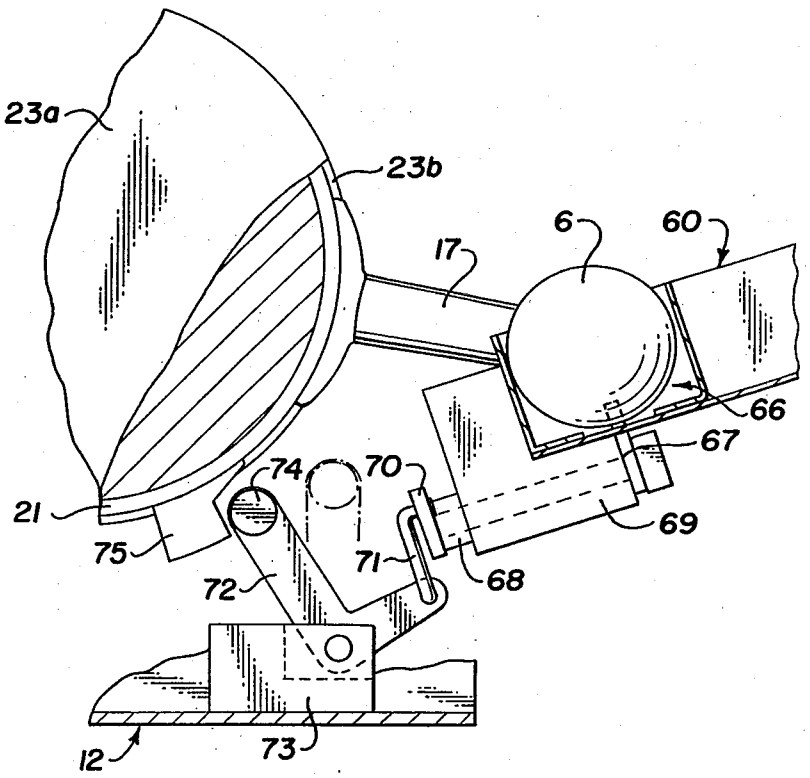
FIG. 11 is a fragmentary view perpendicular to the axis of the idler wheel further illustrating the ball release mechanism.
Figure 10:
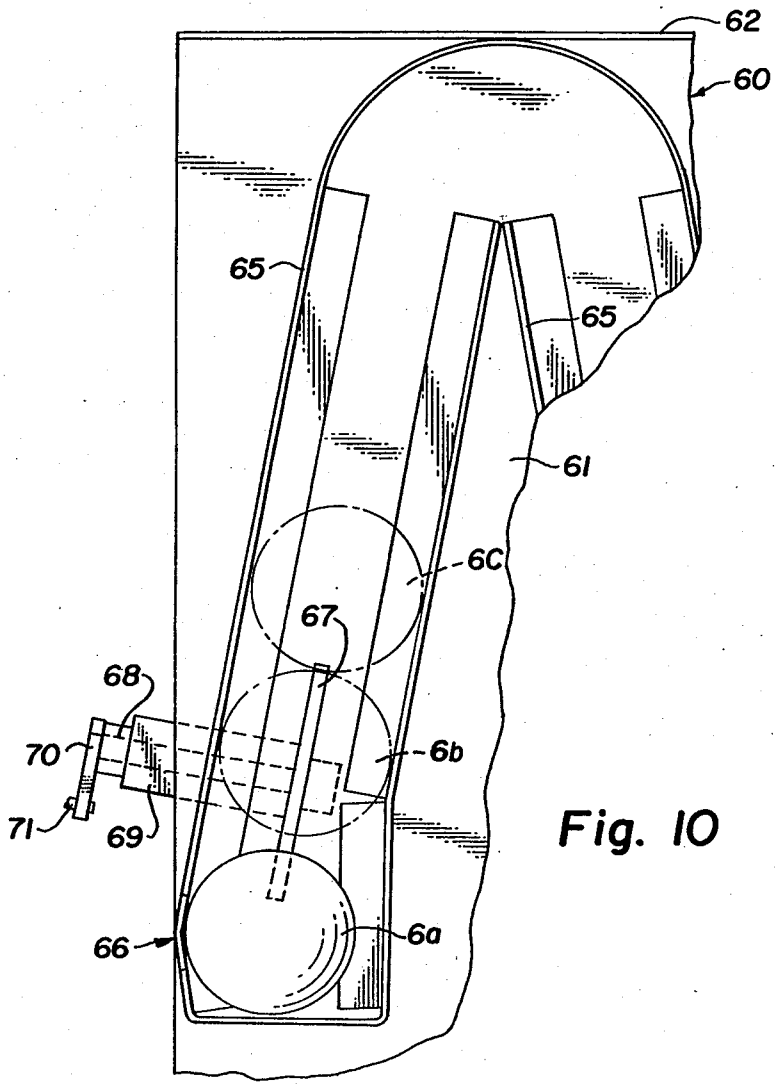
FIG. 10 is a plan view of a modified form of ball supply tray and associated ball release mechanism.

Embodiment of FIGS. 10 through 12

FIGS. 10 and 11 of the drawing illustrate a modified form of ball supply tray and associated release mechanism for releasing a single ball to the ball pickup station. Referring to FIGS. 10 and 11, a ball supply tray 60 has the same general configuration as the above described ball supply tray, including a floor 61, side walls 62, and interior wall members 65 forming the tortuous trough for a single row of balls, the trough terminating in a ball pickup station 66.

A rocker stop 67, having upwardly extending stop ears **67*a* and 67*b* is nonrotatably mounted on a shaft 68 which is rotationally mounted in a bearing block 69 mounted on the tray 60. This assembly is mounted so that the stop ears 67*a* and 67*b* may project alternately through the tray floor into the ball trough adjacent to the pickup station 66. An arm 70, fixed to the end of the shaft 68 opposite from the stop 67 includes means at its distal end for coupling an operator link 71**.

As best seen in FIG. 11, a bell crank 72 is pivotally mounted in a pivot block 73, in turn mounted within the platform ball support section 12. The link 71 is coupled to one end of the bell crank 72; and the other end of the bell crank carries a follower member 74 positioned for engagement by a lug 75 carried on the conveyor belt 21, and positioned slightly behind a golf tee member 17 relative to the direction of movement of the belt.

It will be seen in FIG. 11 that the golf tee member 17 is in the position engaging a ball 6 in the pickup station and about to pick rpand carry the ball from the pickup station. It will also be seen that the dog 75 is about to engage the follower 74 and to rotate the bell crank 72 clockwise (in FIG. 11) until the follower reaches the dotted line position. This rotation of the bell crank will produce accompanying rotation of the rocker stop 67 from a normal position; and after the dog 75 passes the follower 74, the bell crank will be allowed to return to its normal position thereby allowing the rocker stop to return to its normal position. The return to these normal positions may be under the urging of a tortion spring acting between the bearing block 69 and the shaft 68, or other suitable biasing spring.

Figure 12A:
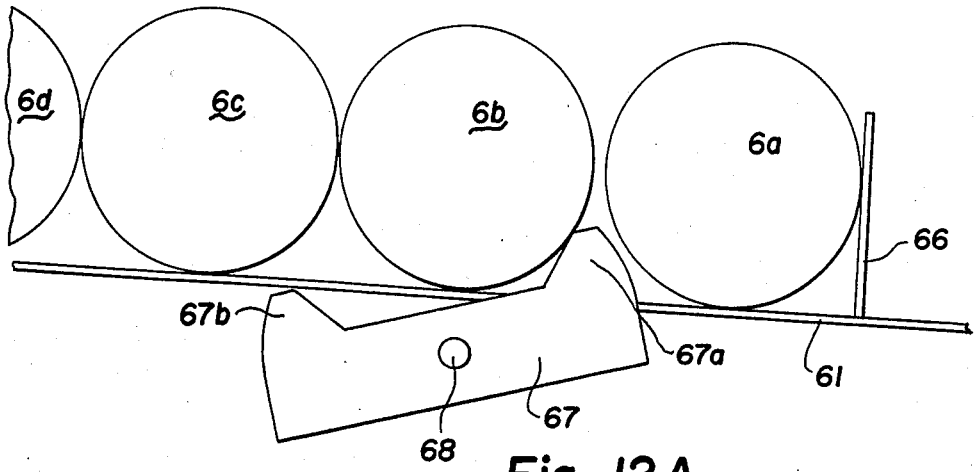
FIGS. 12A, 12B and 12C are diagrammatic views illustrating the operation of the ball release mechanism.
Figure 12B:
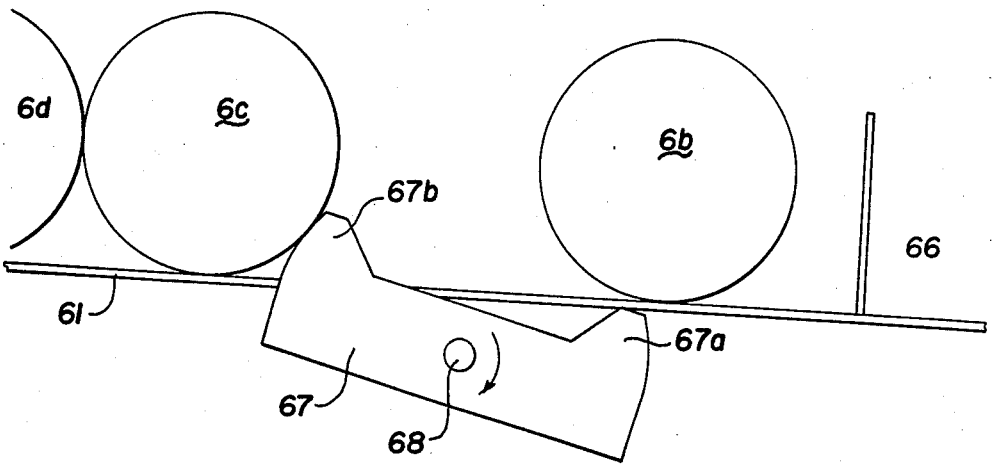

FIGS. 12A, 12B and 13C illustrate diagrammatically the operation of the ball release mechanism. In FIG. 12A a golf ball **6*a* is positioned in the ball pickup station 66; and the rocker stop 67 is shown in its normal rotated position, wherein its ear 67*a* is positioned to stop the ball 6*b* from rolling into engagement with the ball 6*a*. The ball 6*a*, then, is free to be picked up from the pickup station without interference from the following ball. The ball 6*c*** and the following balls roll against the preceding balls by gravity.

FIG. 12B illustrates the rocker stop 67 which has now been rotated to its clockwise limit position through the engagement of the dog 75 with the rocker arm follower 74. The ball **6*a* has now been removed; and the rocker stop ear 67*b* has now been moved into interference relation with the ball 6*b* to prevent its movement while allowing the ball 6*b*** to roll into the pickup station.

Figure 12C:
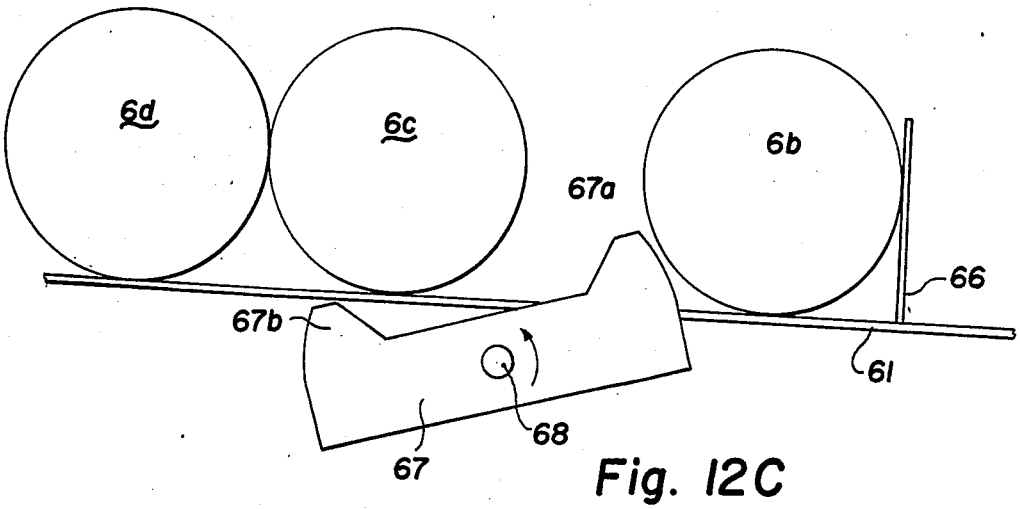

FIG. 12C of the drawing illustrates the rocker stop 67 immediately after its counterclockwise return rotation to the normal position. The ear **67*b* has not been moved to allow rolling movement of the balls 6*c* and 6*d*, and the ear 67*a* is positioned in interference relation to intercept and limit the rolling of the ball 6*c* and the following balls. The balls will then be in positions corresponding to that of FIG. 12A, with ball 6*b* being conditioned for pickup by the following tee member 17**.

Operation and Use

The operation and use of the apparatus will now be briefly summarized. The ball supply tray is loaded, and the golfer assumes his stance on the base platform section 11 in relation to a selected address position of a golf ball along the linear path. The apparatus will convey a succession of golf balls along the linear path, in a direction oposite from that of the intended direction of flight of the ball, toward and through the address position, at a uniform rate of speed and at uniform intervals. The intervals may be eight seconds for example; and this will allow ample time for the golfer to execute his complete golf swing in timed relation to the arrival of the ball at the address position, as illustrated in FIS. 1 and 2, and to get set to repeat his golf swing to hit the next ball. If the golfer is not ready to swing, he may simply pass the ball which will be discharged from the apparatus through the discharge chute.

If the golf balls are conveyed closely along the top of the simulated golfing surface, the golfer is simulating hitting the balls off fairway grass or the grass of a tee surface for example. Importantly, the golfer is swinging at a moving ball approaching the address position from the intended direction of flight, and this invites him to hit through the ball with the proper follow through. The apparatus then provides the means and method for conveying moving balls in a linear path through an address position.

The principal purpose of the apparatus and method is to encourage the golfer to execute his swing with a proper follow through, rather than other fine points of the golf swing which may be concerned with controlling the ball such as producing a hook or a slice or backspin for example. As a secondary purpose, the apparatus may be used as a device for loosening up the golf swing prior to starting a round of golf for example; and for this purpose several units of the apparatus may be placed in the area of the number one tee of a golf course.

What has been described then is a unique apparatus and method to enable a golfer to learn and practice a fundamental aspect of a golf swing, namely a complete follow through. An advantage of the apparatus is that it may be quite compact and very portable, and accordingly may be set up at many convenient locations such as: the number one tee area of a golf course, driving ranges, golf teaching schools, health club or exercise facilities, recreation centers, and in individual homes. An advantage of both the apparatus and method is that they may be employed coincidentally to practice and improve the golf swing, and as a form of basic exercise.

While preferred embodiments of the invention have been illustrated and described, it will be understood by those skilled in the art that changes and modifications may be resorted to without departing from the spirit and the scope of the invention.

What is claimed is:

1. Apparatus for practicing a golf swing comprising platform means providing a flat surface simulating a golfing surface;

a golf tee member including an upper end surface for supporting a golf ball;

said platform surface having linear path means defining intermediate its ends an address position for a golf ball; said linear path means identifying the intended direction of flight of a golf ball from said address position relative to said platform;

means for conveying said golf tee member to traverse said path means from one end to the other parallel to said platform surface; said conveying means conveying said tee member and a golf ball supported thereby in a direction opposite from that of the intended ball flight, to and through said address position to present the ball to be hit from said tee member at said address position.

2. Apparatus as set forth in claim 1 said golf tee member conveying means comprising an endless conveyor; said golf tee member being fixed to said conveyor; and means supporting the upper run of said conveyor in a path parallel to said platform surface.

3. Apparatus as set forth in claim 2 wheel means rotatably supported in said platform means adjacent to the ends of said linear path means, for supporting and driving said conveyor; drive means for driving one of said wheel means.

4. Apparatus as set forth in claim 2 said endless conveyor comprising a flat endless belt; wheel means mounted in said platform means adjacent to one end of said path means for supporting one end of said endless belt;

said tee member comprising an elongated tubular member mounted on said belt to project transversely therefrom; said belt having a transverse port communicating with said tubular tee member in sealed relation;

suction chamber means associated with said wheel means, including a circumferentially elongated port coacting with the underside of said endless belt supported on said wheel means, whereby suction is applied to said tubular golf tee member during a portion of its travel around said wheel means.

5. Apparatus as set forth in claim 4 said liner path means comprising an elongated slot in said platform surface;

supporting means for the upper run of said conveyor belt comprising bracket means underlying said platform surface and said slot, providing a support surface parallel to said platform surface.

6. Apparatus as set forth in claim 5 said endless belt and said golf tee member each being fabricated from a flexible resilient rubber-like material.

7. Apparatus as set forth in claim 5 said golf tee member being fabricated from a flexible resilient rubber-like material; the distal end of said tee member extending through said slot to support a golf ball just above said platform surface.

8. Apparatus as set forth in claim 4 said golf tee member having an annular seating surface at its distal end disposed in a plane parallel to the adjacent tee supporting belt;

said circumferentially elongated port being disposed to communicate with said belt port as said golf tee member approaches and moves to a vertical position above the axis of said wheel means, thereby carrying and positioning a golf ball for gravity support on said golf tee member.

9. Apparatus as set forth in claim 4 golf ball supply means mounted on said platform means comprising: means defining a pickup station, and means defining a tortuous trough inclined downward toward said pickup station; said pickup station being disposed, relative to said wheel means, that the distal end of a golf tee member carried around said wheel means coacts with a ball positioned in said pickup station, whereby said ball is picked up by said golf tee member.

10. Apparatus as set forth in claim 9 selectively movable ball stop means mounted on said golf ball supply means, adjacent to said pickup station;

actuator means for moving said ball stop means selectively into and out of interference relation with balls moving through said trough into said pickup station;

and trip means mounted on said endless belt for actuating said actuator means.

11. Apparatus as set forth in claim 10 said ball stop means comprising a pivotally mounted rocker stop, normally positioned in said interference relation;

said actuator means comprising a bell crank pivotally mounted on said platform means, and linkage means coupling one arm of said bell crank to said rocker stop;

and said trip means comprising a lug fixed to said endless belt for engagement with the other end of said bell crank; said lug engaging said bell crank to move said rocker stop out of said interfering relation

12. Apparatus as set forth in claim 10 said ball stop means comprising a pivotally mounted rocker arm having first and second stop ears at opposite ends thereof; said stop ears being movable alternately into said interference relation; said first stop ear being normally positioned in said interference relation to stop the movement of a ball immediately adjacent to said pickup station; and said second ear being movable into said interference relation to stop the movement of a ball next adjacent to said pickup station;

said actuator means comprising means for moving said first and second ears alternately into said interference relation;

said trip means engaging said actuator means to remove said first ear from, and position said second ear in, said interference relation to release said adjacent ball for movement into said pickup station and for impeding movement of said next adjacent ball; and said trip means then releasing said actuator means to remove said second ear from and to position said first ear in, said interference relation to impede the movement of said next adjacent ball and the following balls.

13. Apparatus as set forth in claim 1 said platform means comprising a base platform, for supporting a golfer, and a ball platform;

said ball platform comprising an elongated housing having said linear path means disposed longitudinally thereof, and supporting said tee member conveying means;

said ball platform being positionable in inverse positions relative to said base platform to select the direction of traversal of said golf tee member relative to said base platform.

14. A method for transporting a golf ball through an address position, for enabling the practice of a golf swing comprising the steps providing a golfing surface;

providing, in relation to said golfing surface, a linear path for movement of a ball supporting tee member through an address position on said golfing surface; said linear path identifying the intended direction of flight of a golf ball from said address position relative to said golfing surface;

conveying tee member having an upper end surface for supporting a golf ball, and a ball supported thereby, along said linear path in a direction opposite from the intended direction of flight, to present the ball to be hit from said tee member at the address position.

15. A method as set forth in claim 14 including the steps providing said linear path as an elongated slot in said golfing surface;

mounting an elongated resilient tubular tee member on a resilient endless belt, to project transversely from said belt;

supporting said belt for movement in a path underlying and paralleling said golfing surface and said slot, whereby said tee member is projected through said slot;

supplying golf balls successively to a pickup station disposed adjacent to said belt for coaction with the distal end of said tee member;

and applying suction to said tubular tee member to effect suction pickup of a ball from said pickup station by said tee member.

16. A method for practicing a golf swing characterized by the steps conveying a ball in a linear path along a generally horizontal golfing surface, through an address position on said golfing surface; said linear path identifying the intended direction of flight of a golf ball from said address position relative to said golfing surface;

adopting a golfing stance on said golfing surface, so related to said address position and said linear path on said golfing surface, that the direction of movement of the conveyed ball is opposite from the intended direction of ball flight;

hitting said ball with a golf club by means of the usual golf swing, when said ball is being conveyed through said address position.

17. A method as set forth in claim 16 characterized by the step timing said golf swings so that the clubhead of said golf club impacts said golf ball at the time said golf ball reaches said address position.

18. A method as set forth in claim 16 characterized by the step conveying said golf ball at a uniform rate of speed.

* * * * *